US005453654A

United States Patent [19]

Bastian et al.

[11] Patent Number: 5,453,654

[45] Date of Patent: Sep. 26, 1995

[54] SINGLE-BASED HIGH-PRESSURE DISCHARGE LAMP WITH A HEAT RETENTION STRUCTURE

[75] Inventors: Hartmuth Bastian, Feuchtwangen; Karl-Heinz Gleixner; Achim Gosslar, both of Munich; Ulrich Henger, Wipperfuerth, all of Germany

[73] Assignee: Patent-Treuhand Gesellschaft F. Elektrische Gluehlampen mbH, Munich, Germany

[21] Appl. No.: 177,530

[22] Filed: Jan. 5, 1994

[30] Foreign Application Priority Data

Feb. 18, 1993 [DE] Germany ..... 93 02 382 U

[51] Int. Cl.[6] ..... H01J 17/16; H01J 61/30

[52] U.S. Cl. ..... 313/25; 313/17; 313/634

[58] Field of Search ..... 313/25, 634, 17

[56] References Cited

U.S. PATENT DOCUMENTS

| | | | |
|---|---|---|---|
| 4,799,135 | 1/1989 | Inukai et al. | 313/25 |
| 4,839,565 | 6/1989 | Osteen | 315/209 R |
| 4,859,899 | 8/1989 | Keeffe et al. | 313/25 |
| 5,128,589 | 7/1992 | Dakin | 313/17 |
| 5,136,204 | 8/1992 | Muzeroll et al. | 313/25 |
| 5,253,153 | 10/1993 | Mathews et al. | 313/25 |

FOREIGN PATENT DOCUMENTS

| | | |
|---|---|---|
| 0290043A3 | 11/1988 | European Pat. Off. . |
| 0381265A1 | 8/1990 | European Pat. Off. . |
| 0465083A3 | 1/1992 | European Pat. Off. . |

*Primary Examiner*—Sandra L. O'Shea
*Assistant Examiner*—Matthew J. Esserman
*Attorney, Agent, or Firm*—Frishauf, Holtz, Goodman, Langer & Chick

[57] ABSTRACT

To simply and reliably retain a heat retention tube or sleeve (10) within an envelope (1) and surrounding the arc tube or discharge vessel (4) of the lamp, end regions of the heat retention or conservation tube are pinched around current supply leads (7) which pass through the pinch or press region (11). To prevent dislocation of the tube or sleeve (10), axially as well as rotationally with respect to the arc tube, the current supply leads are deformed in the region of the pinch or press (11), for example by being flattened or deflected in a bend or V-shape from a straight wire. An exhaust tube (12) can be passed through the pinch (11) if the pinch extends across the entire diameter of the heat retention tube; otherwise, the pinch need only extend over a portion thereof, thus providing for pneumatic communication between the interior of the heat retention tube and the envelope (1).

19 Claims, 4 Drawing Sheets

SINGLE-BASED HIGH-PRESSURE DISCHARGE LAMP WITH A HEAT RETENTION STRUCTURE

Reference to related patent, the disclosure of which is hereby incorporated by reference: U.S. Pat. No. 4,859,899, Keeffe et al.

FIELD OF THE INVENTION

The present invention relates to high-pressure discharge lamps in which a discharge vessel or arc tube retains an ionizing fill therein, and a heat retention structure is provided surrounding the arc tube, with clearance, to maintain the elevated temperature of the arc tube when the lamp is energized.

BACKGROUND

The referenced U.S. Pat. No. 4,859,899, Keeffe et al, the disclosure of which is hereby incorporated by reference, discloses an improved metal halide arc discharge lamp which has an arc tube having an essentially cylindrical body. A heat conserving sleeve surrounds the arc tube. Both the arc tube and the sleeve are located within an evacuated outer envelope. This lamp has improved performance, both with respect to luminous efficacy as well as color rendering index. The discharge vessel or arc tube is retained within the glass envelope of the lamp by a metal holding frame. The heat conserving, heat retention sleeve has open ends and functions as a heat damming or heat conservation tube. It is retained in position within the lamp by the frame which also supports the arc tube. The heat conserving sleeve is secured to the frame by straps. Placing the straps on the frame and securing the sleeve to the frame, and then the entire assembly in the lamp, is complex and time-consuming in manufacture.

THE INVENTION

It is an object to provide a high-pressure discharge lamp, especially of the type described in the referenced U.S. Pat. No. 4,859,899, in which the heat retention or heat conserving sleeve has improved heat conservation effect and, further, is mounted in the lamp by an improved holding arrangement, which is simple and easily made.

Briefly, a heat retention body, typically an open tube of transparent insulating material, is held in position within the outer envelope of the lamp by being directly secured to the current supply leads for the arc tube. The current supply leads pass through end portions of the heat retention body. The heat retention body is formed with pinch or press regions at the end portions thereof where the current supply leads pass through the heat retention body and to the arc tube. Thus, the heat retention body, typically a glass sleeve, is mechanically secured, without requiring additional holding straps and the like.

As is customary, the single-based high-pressure discharge lamp has an outer bulb which is slightly outwardly bulged, to be somewhat barrel-shaped. The heat retention body is a glass tube which coaxially surrounds the discharge vessel over its entire length. The ends of this tube are then pinched or pressed together and clamp on the current supply leads to the arc tube by a pinch or press connection. This secures the heat retention body at its ends and has the additional effect of providing better heat retention or heat damming in the immediate vicinity of the discharge vessel. No additional holding elements are necessary for the heat retention tube.

The cylindrical tube can be held, in rotation locked position, on the current supply leads by simply deforming the usually circular current supply wires, e.g. by forming a flattened portion at the pinch region of the heat retention tube, or deflecting the current supply leads to form a, for example, generally V-shaped kink in the pinch region.

A pump tube can be included in one of the pinch regions if the interior of the heat retention tube is to be evacuated.

DRAWINGS

FIG. 1 is a front view of a single-based high-pressure discharge lamp in accordance with the present invention;

FIG. 2*a* is a cross-sectional view through a pinch region of the heat retention tube in accordance with one embodiment of the invention;

FIG. 2*b* is a view similar to FIG. 2*a*, but rotated 90° about the axis of the current supply lead;

DETAILED DESCRIPTION

Figure 1:
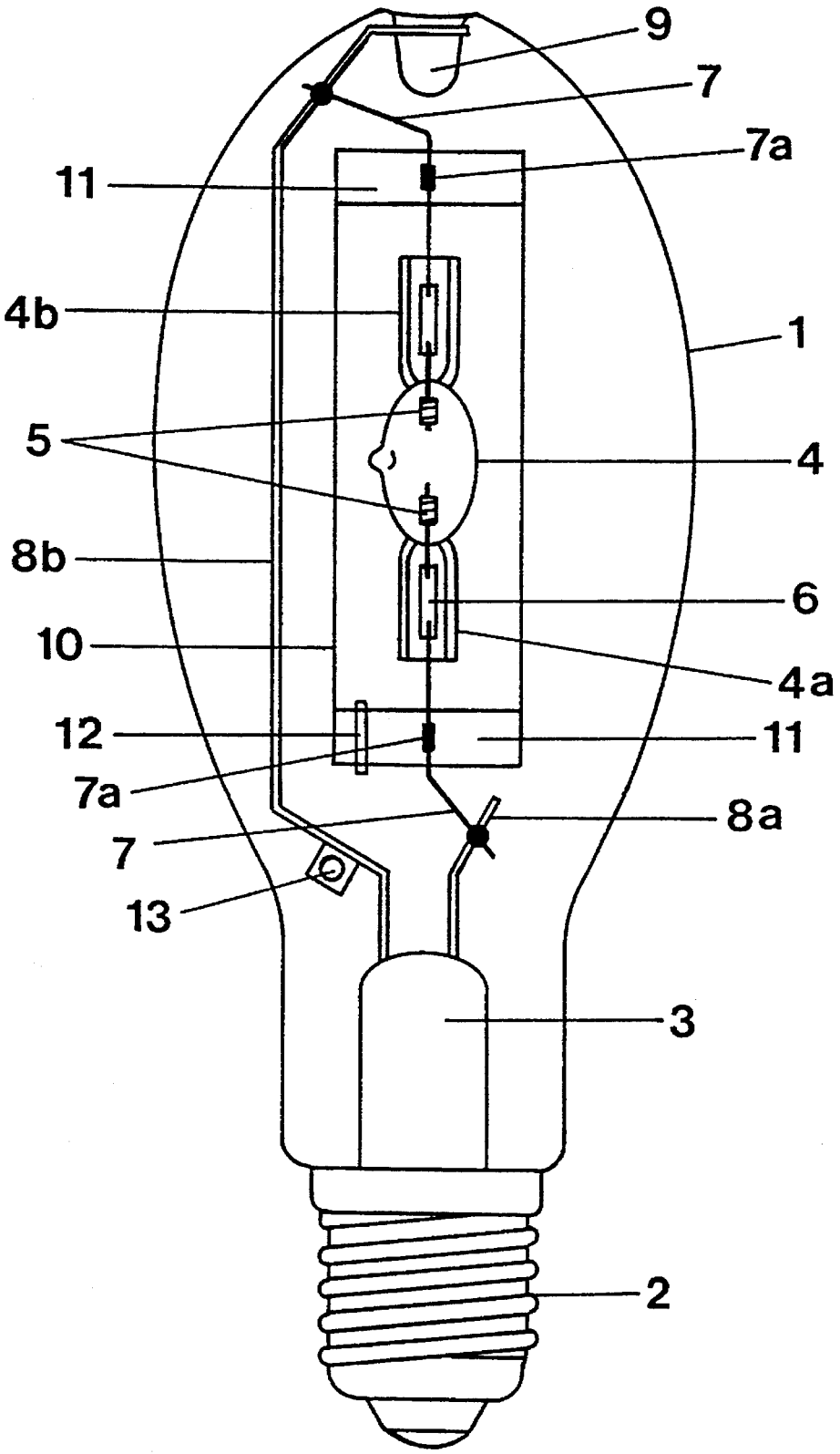

Referring first to FIG. 1:

The lamp has an essentially rotation-symmetrical outer bulb 1 terminating at one end in a screw-in base 2. A flare mount 3 is secured to the base within the envelope 1. A double-ended discharge vessel or arc tube 4 of quartz glass is retained, in axial alignment with respect to the base 2, within the bulb 1. The discharge vessel or arc tube 4 retains two electrodes 5 and an ionizable fill therein. The discharge vessel 4 is sealed by two pinch seals, one pinch seal 4*a* proximate to the base and one pinch seal 4*b* remote or distal from the base. The proximate pinch seal as well as the distal pinch seal each retain a molybdenum foil 6 to which the electrodes 5 are secured, for example by welding, to provide a continuous current connection through the pinch seals of the arc tube 4. Molybdenum current supply leads 7 extend from the pinch seals 4*a*, 4*b* welded to the respective molybdenum foils 6.

The current supply leads 7 are mechanically and electrically securely connected, for example by welding, to separate connecting frame elements 8*a*, 8*b*, respectively, of the lamp frame itself, extending from and melted into the flare mount 3. The frame element 8*b* is welded to the distal current supply lead 7. It extends, in part, parallel to the axis of the lamp and to the discharge vessel 4. It is retained in the bulb 1 at a dimple 9 formed in the outer bulb 1.

The discharge vessel 4 is surrounded over its entire length by a cylindrical, light-transmissive heat retention tube 10.

In accordance with a feature of the present invention, the heat retention tube or heat retention body 10 is secured in position, coaxially surrounding the arc tube 4, by pinching end regions of the tube 10 over and about the respective current supply leads 7. Thus, the entirety of the discharge vessel 4 is located within the heat retention body 10, and the heat retention body 10, in turn, is held in position by the current supply leads 7 leading to the discharge vessel 4.

Figure 2A:
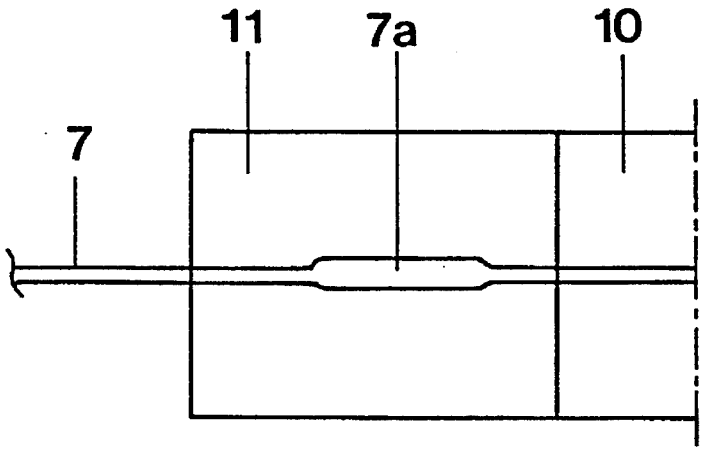
Figure 2B:
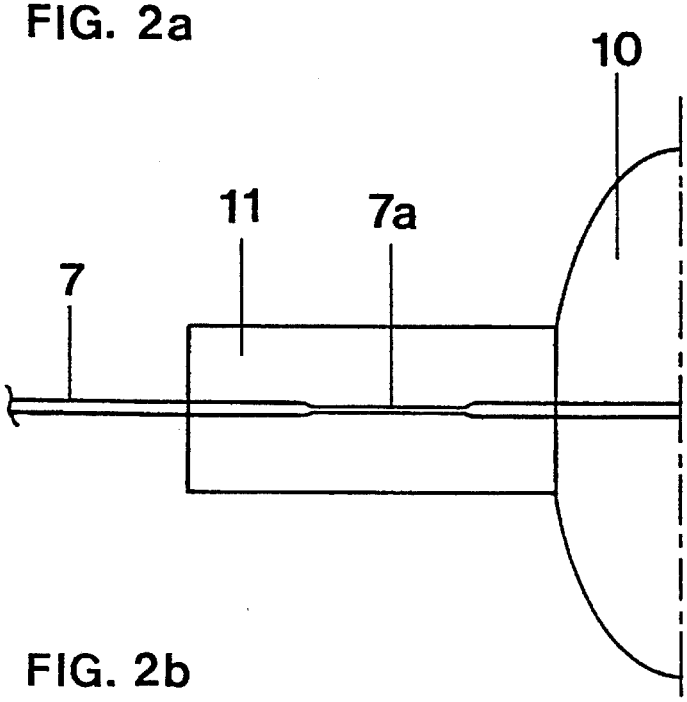

In accordance with a feature of the invention, and to prevent relative rotation of the heat retention tube 10 with respect to the arc tube 4, the usually cylindrical current supply wires, forming the current supply for the arc tube 4, are formed with flattened surfaces 7*a* (see FIGS. 2*a* and 2*b*). These flattened regions 7*a* are located entirely within the pinch or press regions 11 formed on the heat retention tube 10. Flattening or otherwise distorting the current supply leads within the pinch or press region 11 ensures positively positioning the heat retention body 10 and preventing rotation or axial shifting thereof. A pump tube 12 is melted into the proximate pinch region 11 of the body 10 in order to facilitate evacuation of the space within the heat retention tube 10. A getter 13 is secured to the frame element 8*b*.

The pinch region 11, and the flattening of the current supply lead 7 passing therethrough, is best seen in FIGS. 2*a*, 2*b*, in which the respective FIGS. 2*a*, 2*b* are rotated 90° with respect to each other.

Figure 3:
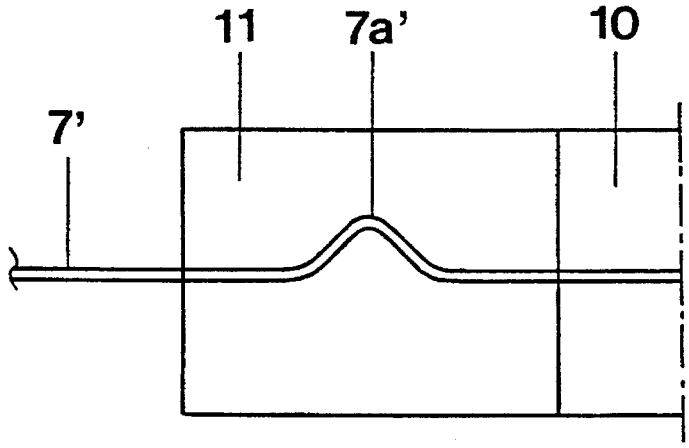
FIG. 3 is a view similar to FIG. 2*a* and illustrating another embodiment of ensuring rotationally restrained engagement between the current supply lead and the heat retention body in the pinch region.

In accordance with another embodiment of the invention, as illustrated in FIG. 3, the direction or shape of the current supply lead 7' is changed or deflected, as shown at 7*a*'. In all other respects, the lamp is the same as that described in connection with FIG. 1.

Figure 4:
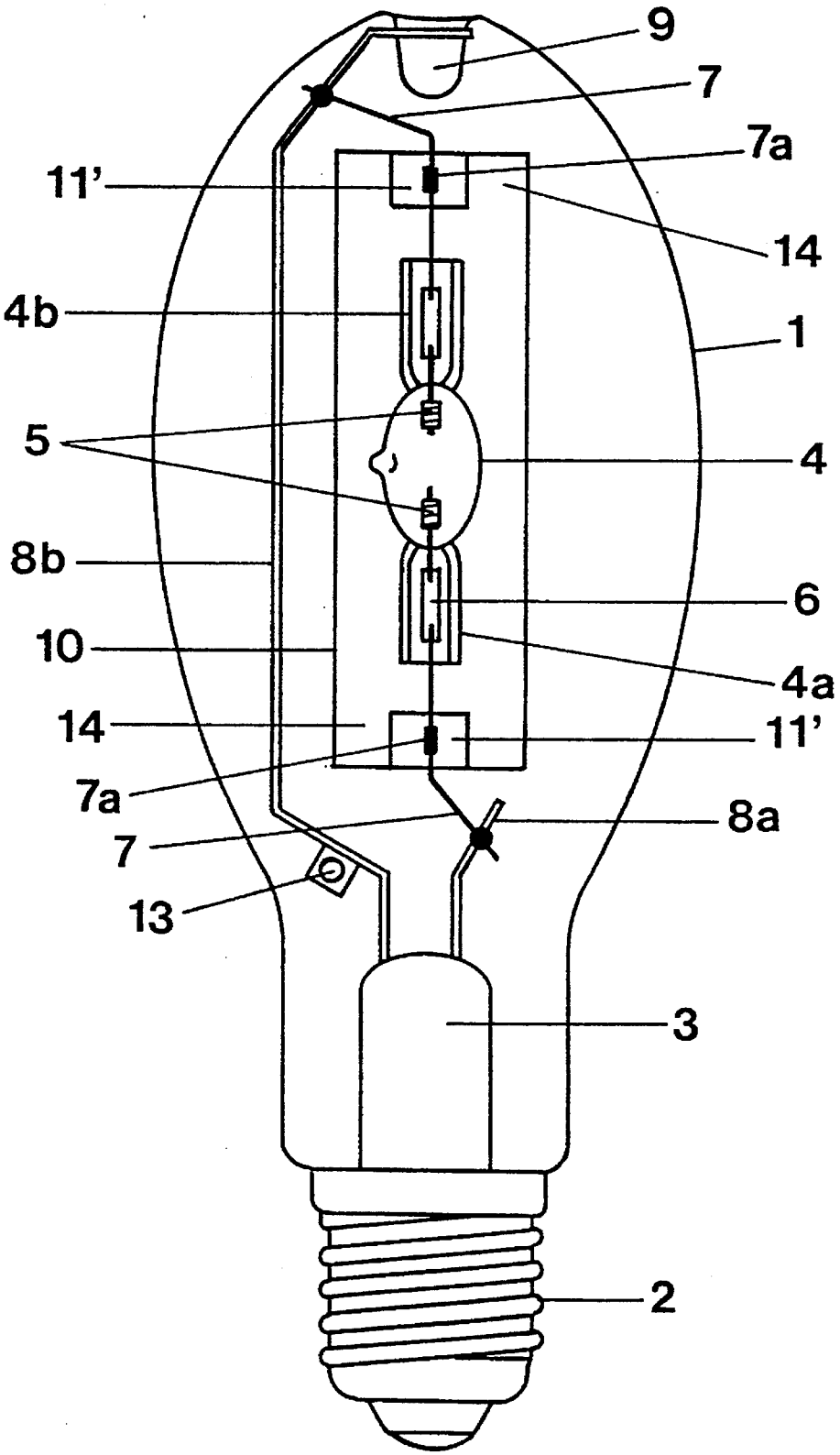
FIG. 4 is a view similar to FIG. 1, and illustrating another embodiment.
Figure 5:
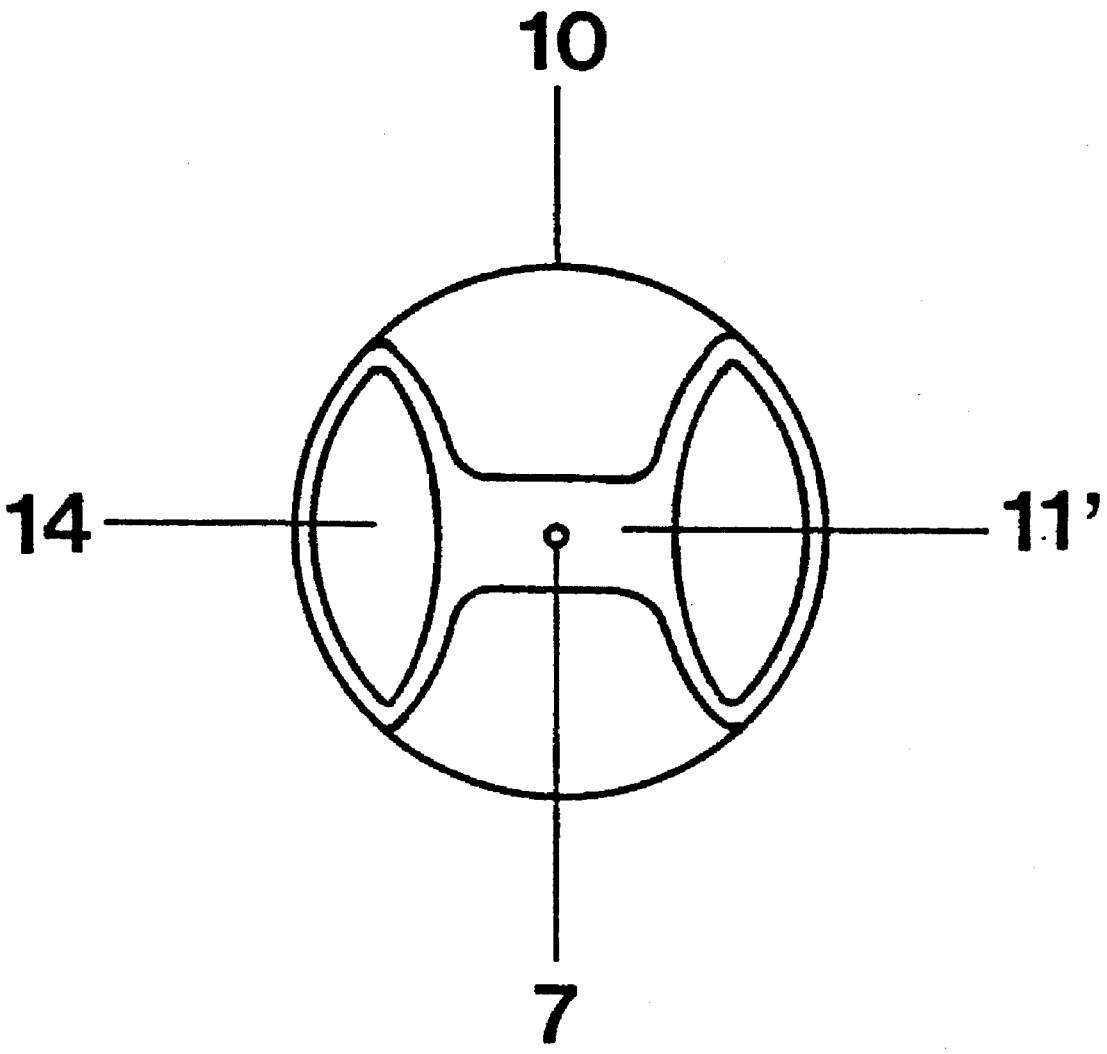
FIG. 5 is an end view of the heat retention body itself in the lamp of FIG. 4.

It is not necessary that the pinch regions 11 extend over the entire width of the heat retention body 10. It is sufficient if the pinch is placed only in the vicinity of the current supply lead 7, that is, merely to retain the body 10 in position on the current supply leads 7 or 7', respectively. FIGS. 4 and 5 illustrate such an arrangement.

In accordance with a feature of the invention, the body 10 is formed with pinch regions 11' leaving unpinched regions 14 (see FIG. 5) extending towards the circumference of the body 10. The body 10, thus, is open in the unpinched regions 14, so that there is communication between the interior of the body 10 and the interior of the outer bulb 1.

In all other respects, the lamps are the same, and the same reference numerals have been used throughout.

Various other changes may be made. For example, the current supply leads can be formed other than being flattened or distorted as shown in FIGS. 2*a*, 2*b* and 3. For example, the current supply lead 7 may be shaped in meander form or a cross element can be welded on the current supply lead where the pinch region 11 is to be formed in order to ensure secure positioning of the body 10 and retention thereof in predetermined position on the current supply leads. If the pinch extends entirely across the body 10, as shown in FIG. 1, other arrangements than placing a pump tube into the pinch to enable evacuation of the space within the body 10 can be used, for example forming a pumping tip, an opening in the wall of the body 10, or the like.

Heat conservation and heat distribution are enhanced by evacuating the space within the envelope 1. For some lamps, however, filling the outer envelope with gas provides protection for the current supply leads 7 and the frame elements 8*a*, 8*b*. The present invention permits establishing the same atmosphere within the body 10 as within the outer envelope 1, for example when utilizing the embodiment of FIGS. 4 and 5, while also permitting establishing different atmospheric conditions within the heat retention body 10 and in the volume within the envelope 1. A first atmospheric condition can be established within the body 10 in accordance with the embodiment of FIG. 1. The pump tube 12 is tipped off before establishing another atmospheric condition within the envelope 1.

Various other changes and modifications may be made, and any features described herein in connection with any one of the embodiments may be used with any of the others, within the scope of the inventive concept.

We claim:

1. Single-based high-pressure discharge lamp having a discharge vessel or arc tube (4);

two electrodes (5) located within the discharge vessel;

electrode current supply leads (7, 7') connected to the electrodes and extending from the discharge vessel (4);

an ionizable fill within the discharge vessel (4);

an outer envelope (1);

a base (2) at an end of the outer envelope;

frame means (8*a*, 8*b*) secured to the outer envelope and the base, supporting and retaining the discharge vessel (4) in position within the outer envelope, spaced from the inner wall of the outer envelope;

an essentially cylindrical sleeve-like heat retention body (10) coaxially surrounding the discharge vessel (4) positioned between the wall of the outer envelope (1) and the discharge vessel and surrounding the discharge vessel over essentially its entire length; and means for securing and retaining said heat retention body (10) in position within the envelope (1), wherein, the current supply leads (7, 7') pass through end portions of the heat retention body (10)

the current supply leads (7, 7') comprise wires of essentially circular cross section; and wherein at least one of the current supply leads is deformed where it is pinched or pressed by the respective pinch or press region (11) of the heat retention body (10); and wherein said heat retention securing and retention means comprises pinch or press regions (11, 11') formed at end portions of the heat retention body (10), mechanically securing said heat retention body to the current supply leads (7, 7').

2. The lamp of claim 1, wherein said pinch or press regions (11) extend across the entire diameter of the heat retention body (10).

3. The lamp of claim 2, further including a pump tube (12) embedded in one of the pinch or press regions (11).

4. The lamp of claim 1, wherein the deformation comprises a flattened region (7*a*) of the at least one current supply lead (7).

5. The lamp of claim 1, wherein the deformation comprises a bent or deflected zone (7*a*) of the at least one current supply lead (7'), in which said deflection is positioned in the plane formed by the pinch or press region (11).

6. The lamp of claim 5, wherein the deformation is of essentially V shape, in the plane of the pinch or press region (11).

7. The lamp of claim 1, wherein both current supply leads (7) are deformed.

8. The lamp of claim 4, wherein both current supply leads (7) are deformed.

9. The lamp of claim 5, wherein both current supply leads (7) are deformed.

10. The lamp of claim 6, wherein both current supply leads (7) are deformed.

11. Single-based high-pressure discharge lamp having a discharge vessel of arc tube (4);

two electrodes (5) located within the discharge vessel;

electrode current supply leads (7, 7') connected to the electrodes and extending from the discharge vessel (4);

an ionizable fill within the discharge vessel (4);

an outer envelope (1);

a base (2) at an end of the outer envelope;

frame means (8*a*, 8*b*) secured to the outer envelope and the base, supporting and retaining the discharge vessel (4) in position within the outer envelope, spaced from the inner wall of the outer envelope;

an essentially cylindrical sleeve-like heat retention body (10) coaxially surrounding the discharge vessel (4) positioned between the wall of the outer envelope (1) and the discharge vessel and surrounding the discharge vessel over essentially its entire length; and means for securing and retaining said heat reduction body (10) in position within the envelope (1), wherein, the current supply leads (7, 7') pass through end portions of the heat retention body (10), said heat retention securing and retention means comprises pinch or press regions (11, 11') formed at end portions of the heat retention body (10), mechanically securing said heat retention body to the current supply leads (7, 7'); and wherein the pinch or press region extends only across a portion of the diameter of the heat retention body (10) leaving open regions (14) between the pinch and press regions (11') and the inner circumference of the heat retention body, said unpinched regions providing for pneumatic communication between the interior of the heat retention body and the inside of said outer envelope (1).

12. The lamp of claim 11, wherein the current supply leads (7, 7') comprise wires of essentially circular cross section; and wherein at least one of the current supply leads is deformed where it is pinched or pressed by the respective pinch or press region (11) of the heat retention body (10).

13. The lamp of claim 12, wherein the deformation comprises a flattened region (7*a*)of the at least one current supply lead (7).

14. The lamp of claim 12, wherein the deformation comprises a bent or deflected zone (7*a'*) of the at least one current supply lead (7'), in which said deflection is positioned in the plane formed by the pinch or press region (11).

15. The lamp of claim 14, wherein the deformation is of essentially V shape, in the plane of the pinch or press region (11).

16. The lamp of claim 12, wherein both current supply leads (7) are deformed.

17. The lamp of claim 13, wherein both current supply leads (7) are deformed.

18. The lamp of claim 14, wherein both current supply leads (7) are deformed.

19. The lamp of claim 15, wherein both current supply leads (7) are deformed.

* * * * *